US005266164A

United States Patent [19]

Novak et al.

[11] Patent Number: 5,266,164

[45] Date of Patent: Nov. 30, 1993

[54] PAPERMAKING PROCESS WITH IMPROVED DRAINAGE AND RETENTION

[75] Inventors: Robert W. Novak, Lisle; Thomas C. Fallon, West Chicago, both of Ill.

[73] Assignee: Nalco Chemical Company, Naperville, Ill.

[21] Appl. No.: 976,987

[22] Filed: Nov. 13, 1992

[51] Int. Cl.[5] ..... D21H 17/34

[52] U.S. Cl. ..... 162/168.2; 162/168.1; 162/183

[58] Field of Search ..... 162/168.2, 168.3, 183, 162/164.6, 168.1

[56] References Cited

U.S. PATENT DOCUMENTS

| | | | |
|---|---|---|---|
| 4,753,710 | 6/1988 | Langley et al. | 162/168.2 |
| 4,913,775 | 4/1990 | Langley et al. | 162/183 |
| 5,098,520 | 3/1992 | Begala | 162/168.2 |

*Primary Examiner*—Peter Chin

*Attorney, Agent, or Firm*—Robert A. Miller; James J. Drake

[57] ABSTRACT

The invention provides a method for improving the retention of mineral fillers and cellulose fibers on a cellulosic fiber sheet. The method comprising the steps of preparing a cellulose pulp slurry; adding before a shearing step an effective amount of a copolymer flocculant to the cellulose pulp slurry, the copolymer flocculant is a high molecular weight cationic copolymer of acrylamide and diallyl dimethyl ammonium chloride, the flocculant copolymer should contain from about 20 to about 60 mole percent diallyl dimethyl ammonium chloride mer units. After a shearing step adding an effective amount of a high molecular weight water-soluble anionic flocculant. A cellulosic fiber sheet is then formed from the cellulose pulp slurry which includes both the copolymer flocculant and anionic flocculant.

3 Claims, No Drawings

PAPERMAKING PROCESS WITH IMPROVED DRAINAGE AND RETENTION

TECHNICAL FIELD OF THE INVENTION

The present invention is in the technical field of papermaking; and, more particularly, in the technical field of wet-end additives to papermaking furnish.

BACKGROUND OF THE INVENTION

In the manufacture of paper an aqueous cellulosic suspension or slurry is formed into a paper sheet. The cellulosic slurry is generally diluted to a consistency (percent dry weight of solids in the slurry) of less than 1 percent. Often a slurry of below 0.5 percent is used just ahead of the paper machine. However, while the finished sheet must have less than about 6 weight percent water. Hence the dewatering aspects of papermaking are extremely important to the efficiency and cost of the manufacture.

The least costly dewatering method is simple drainage. More expensive methods which are used include vacuum, pressing, felt blanket blotting and pressing, and evaporation. In practice a combination of such methods are employed to dewater, or dry the sheet to the desired water content. Since drainage is both the first dewatering method employed and the least expensive, improvement in the efficiency of drainage will decrease the amount of water required to be removed by other methods and hence improve the overall efficiency of dewatering and reduce the cost thereof.

Another aspect of papermaking that is extremely important to the efficiency and cost of the manufacture is retention of furnish components on and within the fiber mat being formed during papermaking. A paper making furnish generally contains particles that range in size from the 2 to 3 millimeters of cellulosic fibers, to fillers at a few microns and to colloids. Within this range are cellulosic fines, mineral fillers (employed to increase opacity, brightness and other paper characteristics) and other small particles that generally, without the inclusion of one or more retention aids, would in significant portion pass through the spaces (pores) between the cellulosic fibers in the fiber mat being formed during papermaking.

One method of improving the retention of cellulosic fines, mineral fillers, and other furnish components on the fiber mat is the use of a coagulant/flocculant system added ahead of the paper machine. In such a system there is first added a coagulant, for instance a low molecular weight synthetic cationic polymer or a cationically modified starch to the furnish, which coagulant generally reduces the negative surface charges present on the particles in the furnish, particularly cellulosic fines and mineral fillers, and thereby accomplishes a degree of agglomeration of such particles, followed by the addition of a flocculant. Such flocculant generally is a high molecular weight anionic synthetic polymer which bridges the particles and/or agglomerates, from one surface to another, binding the particles into large agglomerates. The presence of such large agglomerates in the furnish as the fiber mat of the paper sheet is being formed increases the retention of particles to the fiber mat. The agglomerates are filtered out of the water onto the fiber web where unagglomerated particles would to a great extent pass through such paper web.

While a flocculated agglomerated generally does not interfere with the drainage of the fiber mat to the extent that would occur if the furnish were gelled or contained an amount of gelatinous material, when such flocs are filtered by the fiber web the pores thereof are to a degree reduces, reducing the drainage efficiency therefrom. Hence the retention is being increased with some degree of deleterious effect on the drainage.

Another system employed to provide an improved combination of retention and dewatering is described in U.S. Pat. Nos. 4,753,710 and 4,913,775, inventors Langeley et al., both of which are hereinafter incorporated by reference. In brief, such method adds to the aqueous cellulosic papermaking suspension first a high molecular weight linear cationic polymer followed by the addition of bentonite after shearing. The shearing generally is provided by one or more stages of the papermaking process and the shearing breaks down the large flocs formed by the high molecular weight polymer into microflocs, and further agglomeration then ensues with the addition of the bentonite particles.

Another system uses the combination of cationic starch followed by colloidal silica to increase the amount of material retained on the web by the method of charge neutralization and adsorption of smaller agglomerates. This system is described in U.S. Pat. No. 4,388,150. Yet another variation of this system is described in U.S. Pat. Nos. 4,643,801 and 4,750,974, both of which are hereinafter incorporated by reference which in addition to the use of a cationic starch and colloidal silica employ, with or without the starch, a high molecular weight anionic polymer.

U.S. Pat. No. 4,795,531 teaches the use of a retention and drainage aid program consisting of a low molecular weight cationic polymer coagulant, colloidal silica sol and a high molecular weight polymer flocculant which may be anionically or cationically charged.

Additional systems to improve drainage and retention have also been proposed. Among these systems are the use of a single, high molecular weight cationic polymer as exemplified in South African Patent 2389/90 corresponding to U.S. Ser. No. 397,224 filed Aug. 23, 1989. U.S. Pat. No. 5,098,520 suggests a drainage and retention program in which, a cellulosic papermaking slurry containing a mineral filler is treated with a high molecular weight cationic (meth)acrylamide polymer prior to at least one shear stage followed by the addition of a low molecular weight anionic polymer at least one shear stage subsequent to the addition of the cationic polymer.

Dewatering generally, and particularly dewatering by drainage, is believed improved when the pores of the paper web are less plugged, and it is believed that retention by adsorption in comparison to retention by filtration reduces such pore plugging.

Greater retention of fines and fillers permits, for a given grade of paper, a reduction in the cellulosic fiber content of such paper. As pulps of less quality are employed to reduce papermaking costs, the retention aspect of papermaking becomes even more important because the fines content of such lower quality pulps is greater generally than that of pulps of higher quality.

Greater retention of fines, fillers, and other slurry components reduces the amount of such substances lost to the white water and hence reduces the amount of material wastes, the cost of waste treatment and disposal, and the adverse environmental effects therefrom.

Another important characteristic of a given papermaking process is the formation of the paper sheet produced. Formation is determined by the variance in light transmission within a paper sheet, and a high variance is indicative of poor formation. As retention increases to a high level, for instance a retention level of 80 or 90 percent, the formation parameter generally abruptly declines from good formation to poor formation. It is at least theoretically believed that as the retention mechanisms of a given papermaking process shift from filtration to adsorption, the deleterious effect on formation, as high retention levels are achieved, will diminish and a good combination of high retention with good formation is attributed to the use of bentonite in U.S. Pat. No. 4,913,775.

It is generally desirable to reduce the amount of material employed in a papermaking process for a given purpose without diminishing the result sought. Such add-on reductions may realize both a material cost savings and handling and processing benefits.

It is also desirable to use additives that can be delivered to the paper machine without undue problems. Additives that are easily dissolved or dispersed in water minimize the expense and energy required for delivering them to the paper machine and provide a more reliable uniformity of feed than additives which are not easily dissolved or dispersed.

SUMMARY OF THE INVENTION

The present invention provides a papermaking process in which paper or paperboard is made by the general steps of forming an aqueous cellulosic slurry and draining such slurry to form a fiber mat which is then dried, characterized by the addition of an effective amount of high molecular weight cationic water-soluble flocculant polymer to the pulp slurry, prior to at least one shear stage followed by the addition of an effective amount of a high molecular weight anionic water-soluble polymer flocculant to the slurry before such fiber mat formation. The present invention provides a papermaking process in which the retention is increased without diminishing the formation, and further without any undue detrimental effect on drainage efficiency. The high molecular weight cationic polymer flocculants and the high molecular weight anionic polymer flocculants are effective at low dosage levels, and are easily supplied to the papermaking system. The present invention provides superior performance over conventional "dual polymer" retention and drainage programs in which a cationic coagulant and an anionic flocculant are employed. Further advantages of the present invention will become apparent in the disclosure below.

PREFERRED EMBODIMENT OF THE INVENTION

A method for improving the retention of mineral fillers and cellulose fibers on a cellulosic fiber sheet. The method comprises several steps. One step is preparing a cellulose pulp slurry. To the pulp slurry is added an effective amount of a copolymer flocculant. The copolymer flocculant being a high molecular weight cationic copolymer of acrylamide and diallyl dimethyl ammonium chloride. The flocculant copolymer preferably contains from about 20 to about 60 mole percent dially dimethyl ammonium chloride mer units. More preferably, the copolymer includes about 30 to about 40 mole percent diallyl dimethyl ammonium chloride mer units. The cellulose pulp slurry is then preferably sheared. An effective amount of a high molecular weight water-soluble anionic flocculant is thereafter added to the sheared cellulose pulp slurry. A cellulosic fiber sheet is then formed from the cellulose pulp slurry which includes both the copolymer flocculant and anionic flocculant.

The use of polymers of various types for the purpose of improving drainage and retention performance in papermaking processes is well known. Such polymers range from "natural" polymers such as starches, to synthetic polyelectrolytes of wide variety. Such polyelectrolytes include anionic polymers, cationic polymers, and amphoteric polymers. Such polymers also include nonionic polymers such as the nonionic, but polar, polyacrylamides. These polymers are typically water-soluble at the concentration levels employed.

A common retention aid system, referred to as a dual polymer system, employs a low molecular weight cationic polymer coagulant followed by the addition of a high molecular weight anionic polymer flocculant. The functional terms coagulant and flocculant of course are based upon the effect a polymer has on the cellulosic slurry particles. A coagulant generally neutralizes a surface charge on a particle, a cationic coagulant neutralizing a negative surface charge on a particle. A flocculant binds to sites on a plurality of such particles, providing a bridging effect. As to the structural characteristics distinguishing a polymeric coagulant from a polymer flocculant, a coagulant is a low molecular weight polymer while a flocculant is a high molecular weight polymer. A coagulant further must be cationic so as to neutralize the negative particle surface charges. A flocculant generally is, but need not be, anionic.

High molecular weight cationic polymer flocculants have been used heretofore in the papermaking process as substitutes for the high molecular anionic flocculant of the dual polymer retention and drainage aid system. These cationic flocculants have, however, been relatively low charge density polymers, having mole percentages of cationic mer units of about 10 percent and charge densities on the order of 1.0 or 1.2 equivalents of cationic nitrogen per kilogram of dry polymer or less. In contrast, the low molecular weight cationic coagulants they have been used with typically have high charge densities, such as from about 4 to about 8 equivalents of cationic nitrogen per kilogram of dry polymer.

The high molecular weight, high charge density cationic polymer flocculants employed in the present process as one component of the two component retention and drainage aid system typically contain 60 mole percent or less of cationic mer units, and preferably contains from 20–60 mole percent of cationic mer units. Most preferably the high molecular weight cationic polymer of this invention contains 40–50 mole percent of cationic mer units.

The cationic flocculants of the subject invention typically have charge densities of from about 2 to about 4 equivalents of cationic nitrogen per kilogram of dry polymer and preferably have a charge density of about 2.5 to about 3.4 equivalents of cationic nitrogen per kilogram of dry polymer. A particularly preferred polymer useful in this invention has a charge density of about 2.8 equivalents of cationic nitrogen per kilogram of dry polymer. This charge density is substantially lower than the cationic coagulants of the prior art they replace, but is generally higher than the charge densities of cationic flocculants which have been used as the flocculant in two component coagulant/flocculant programs.

The cationic flocculant polymers of this invention differ from the cationic coagulant materials they replace, in that they have substantially higher molecular weights. While the molecular weight of a typical cationic coagulant may range from several thousand to 200,000, the molecular weight of the cationic polymers useful in this invention range from approximately 1,000,000 to 20,000,000 or higher. While the molecular weight of the polymers of this invention may not be specifically estimated, cationic flocculant polymers, polymers useful in this invention have reduced specific viscosities ranging from as low as 4 to as high as 22 or greater as compared to cationic coagulants which generally have intrinsic viscosities less than 1.

The preferred cationic flocculant polymers useful in this invention are copolymers of acrylamide and diallyl dimethyl ammonium chloride (DADMAC). The preferred cationic flocculant polymers useful in this invention contain, as stated above from 20–60 mole percent of diallyldimethylammonium chloride and preferably from 20–55 mole percent of diallyl dimethyl ammonium chloride. Most preferably the cationic flocculant polymers of this invention contain from 40–50 mole percent of diallyl dimethyl ammonium chloride. While acrylamide is a preferred comonomer in the manufacture of these polymers due to its commercial availability, and non-ionic character, other non-ionic monomers may be employed so long as the resultant polymer remains water-soluble and contains no appreciable anionic charge. Examples of other non-ionic monomers which may be polymerized with diallyl dimethyl ammonium chloride include methacrylamide, and vinyl esters such as methyl methacrylate.

The molecular weight of the cationic flocculant materials of this invention can vary widely. The cationic flocculant materials useful in this invention have molecular weights of a least one million. While molecular weights can only be estimated, preferred polymers have reduced specific viscosities of from 3 to 9, and preferably, 4 to 7. A particularly preferred copolymer of acrylamide and diallyl dimethyl ammonium chloride has a reduced specific viscosity of about 5.

The synthesis of these types of polymers is well known as exemplified in Lim at al., U.S. Pat. No. 4,077,930 or in Anderson, et al., U.S. Pat. No. 3,624,019, both of which are hereinafter incorporated by reference into this disclosure. The diallyl dimethyl ammonium chloride copolymer flocculants of this invention may also be prepared in dilute aqueous solution form, although such methods are not preferred.

The anionic high molecular weight water-soluble flocculant component of the retention and drainage aid of this invention are well known. The high molecular weight anionic polymer flocculants used are preferably high molecular weight water-soluble polymers having a molecular weight of at least 500,000, preferably a molecular weight of at least 1,000,000 and most preferably having a molecular weight ranging between about 5,000,000–25,000,000. Molecular weights in this range typically correspond to reduced specific viscosity of 20–55.

The anionic polymer flocculants are water-soluble vinylic polymers containing at least 5 mole percent of mer units having an anionic charge, preferably 5–95 mole percent of anionic mer units and most preferably 20–80 mole percent of anionic mer units. Typically, these polymers are polymers or copolymers of acrylic or methacrylic acid or their water-soluble alkali metal salts, hydrolyzed polyacrylamide, copolymers of acrylamido methyl/propane sulfonic acid, vinyl sulfonate, or other sulfonate containing monomers. Generally, the anionically charged monomer is co-polymerized with a non-ionic monomer such as acrylamide, methacrylamide, methyl or ethyl acrylate or the like. The anionic polymers may also be sulfonate or phosphonate containing polymers which have been synthesized by modifying acrylamide polymers in such a way as to obtain sulfonate or phosphonate substitution, or admixtures thereof. The anionic polymers may be used in solid, powder form, after dissolution in water, or may be used as water-in-oil emulsions, wherein the polymer is dissolved in the dispersed water phase of these emulsions.

It is preferred that the anionic polymers have a molecular weight of at least 1,000,000. The most preferred molecular weight is at least 5,000,000, with best results observed when the molecular weight is between 5.0–25 million. The anionic polymers have a degree of substitution of at least 0.01, preferably a degree of substitution of at least 0.05, and most preferably a degree of substitution of at least 0.10–0.50. By degree of substitution, we mean that the polymers contain randomly repeating monomer units containing chemical functionality which when dissolved in water become anionically charged, such as carboxylate group, sulfonate groups, phosphonate groups, and the like. As an example, a copolymer of acrylamide and acrylic acid wherein the monomer mole ratio of acrylamide to acrylic acid is 90:10, would have a degree of substitution of 0.10. Similarly, copolymers of acrylamide and acrylic acid with monomer mole ratios of 50:50 would have a degree of anionic substitution of 0.5.

THE USE OF THE CATIONIC AND ANIONIC FLOCCULANTS OF THIS INVENTION

In the practice of our invention the cationic high molecular weight water-soluble flocculant is preferably added to the pulp slurry at some point after the machine chest and before shearing in the fan pump so that the cationic flocculant is present in the pulp slurry when, as in a typical papermaking process, the white water is added to the system. Preferably, this is before any shearing occurs. The anionic flocculant is preferably added to the pulp slurry either before or immediately after a shear step and after the pressure screen preceding the head box to the paper machine. It is important that the anionic flocculant be added to the pulp slurry after the cationic flocculant has been added.

The cationic flocculant is generally added at a rate of 0.1–3.0 pounds of polymer solids per ton of total solids in the pulp slurry. Preferably, the cationic flocculant is added at a rate of 0.1–2.0 pounds of polymer solids per ton of total solids in the pulp slurry and most preferably, from 0.1–1.5 pounds of polymer solids per ton of total solids in the pulp slurry. This amount compares with a typical addition of from 0.2–10 pounds of polymer solids per ton of total solids when cationic coagulants such as ethylene dichloride-ammonia or epichlorohydrin-dimethylamine condensation polymers are used in conventional "dual polymer" retention and drainage programs.

The anionic flocculant is generally added at a rate of 0.1–3.0 pounds of polymer solids per ton of total solids in the pulp slurry. Preferably, the anionic flocculant is added at a rate of 0.1–2.0 pounds of polymer solids per ton of total solids in the pulp slurry, and most preferably, from 0.1–1.5 pounds of polymer solids per ton of total solids in the pulp slurry.

In order to show the benefits of this invention, the following examples are presented:

Example I

Standard Test Procedure For Retention Determination

The following test procedure is a laboratory method that simulates a paper machine and provides data concerning retention, drainage and other performance parameters. The data provided by this test procedure is comparable to that realized in the commercial papermaking process being simulated. A 500 ml. sample of standard stock (cellulosic slurry) is used. Any adjustments necessary to the stock's consistency and pH are made prior to charging the treatment and/or commencement of the mixing. A Britt jar obtained from PRM Incorporated of Syracuse, N.Y. is employed as the mixing vessel to provide a standard degree of shear. This apparatus is comprised of a chamber having a capacity of about one liter and is provided with a variable speed motor equipped with a two-inch three-bladed propeller. The sample of standard stock is first added to the Britt jar and then the treatment is added. The stock/treatment combination is then mixed at a speed and for the time period desired, after which filtrate is collected for 10 seconds. The transmittance of the filtrate compared to a blank is then determined. Increasing transmittance reflects increasing retention of fines, minerals fillers and fiber on the mat. The furnish is removed from the Britt jar and placed in a drainage testing device consisting of a Buchner found on top of a 250 ml graduated cylinder. A coarse filter paper is laid on top of the Buchner, and vacuum of 30 inches Hg is applied. 250 ml of furnish is poured on the filter pad and the time taken to remove 200 ml of water is recorded as the drainage time. The resultant formed pad along with the coarse filter is removed and weighed to determine the percent consistency. Percent consistency is an indication of the percent solids in the formed pad and is based on the weight of the formed pad plus filter paper less the weight of the known furnish solids and filter paper. This result gives the weight of water in the formed pad from which the % consistency (or % solids) may be readily calculated. The variables used in all instances for this standard procedure are set forth below in Table I.

TABLE I

| Britt Jar Test Conditions for Polymeric Flocculant Testing | |
|---|---|
| Stock: | Mill furnish, 35% BHWK[1] - 35% BSWK[2], 30% Broke, 20 wt % Pfizer[3] Albacar HO |
| Jar: | PMR Inc. Standard three vaned |
| Screen: | 100R |
| Drainage: Tip | 5 ml disposable pipet, 80 -90 mls/30 sec |
| RPM's: | 1000 |
| Timing: | t = 0 sec.; start mixing and add stock |
| Sequence | t = 10 sec.; add cationic starch - Stalock 400[4] |
| | t = 40 sec.; add alum (if present) |
| | t = 45 sec.; add coagulant or cationic flocculant of this invention |
| | t = 55 sec.; add anionic flocculant |
| | t = 65 sec.; begin filtrate collection |
| | t = 95 sec., stop filtrate collection and end |

TABLE I-continued

| Britt Jar Test Conditions for Polymeric Flocculant Testing |
|---|
| experiment |

[1]bleached hardwood Kraft
[2]bleached softwood Kraft
[3]a precipitated calcium carbonate available from Pfizer Inc., New York, New York
[4]Stalock 400 is a cationic starch available from A. E. Staley, Corp., Decatur, Illinois

DESCRIPTION OF POLYMERS USED

1. An acrylamide-dially dimethyl ammonium chloride copolymer having 30 mole % mer units of diallyldimethylammonium chloride and a reduced specific viscosity of approximately 4.5 was obtained. The polymer was made in water-in-oil emulsion form which contained approximately 35% polymer solids. The material had a charge density of 3.2 meg gram polymer. This material is referred to as Polymer A.

2. An epichlorohydrin-dimethyl amine condensation polymer was obtained. This commercially available material was a solution polymer containing 50% polymer solids. It had an intrinsic viscosity of 0.4 in 0.1N $NaNO_3$ of 0.4 and a charge density of 7.0 meg/g polymer. This material is referred to as Polymer B.

3. A low molecular homopolymer of polydially dimethyl ammonium chloride was obtained. This polymer was prepared in solution at a concentration of 15% by weight polymer solids. It had an intrinsic viscosity of 1.0 and a charge density of 6.8 meg/gram polymer. This material is referred to as Polymer C.

4. A copolymer of acrylic acid and acrylamide containing 31 mole % acrylic acid mer units was obtained. The polymer was made in water-in-oil emulsion form, contained 28% by weight polymer solids, had a charge density of 3.2 meg/g and a reduced specific viscosity of 38. The polymer was in the sodium salt form. This material is referred to hereinafter as Polymer D.

Using the above test method on the above-described furnish, the following surprising results were obtained. All runs shown below contained 0.1% by weight polymer "D" solids based on total solids in the furnish.

TABLE II

| Treatment | Dosage (#Polymer as Product/ Ton Furnish Solids | % Trans. | Drainage Time | % Consistency |
|---|---|---|---|---|
| Anionic Polymer only | 0 | 22 (Avg.) | | |
| Polymer C | 1 | 26 | | |
| | 2 | 26 | 18.6 sec. (avg.) | 21.09% (avg.) |
| | 3 | 25 | | |
| | 4 | 27 | | |
| Polymer A | 1 | 27 | | |
| | 2 | 27 | 15.20 sec. | |
| | 3 | 28 | (avg.) | 21.57% (avg.) |
| | 4 | 34 | | |
| Polymer B | 1 | 24 | | |
| | 2 | 23 | 17.8 sec. (avg.) | |
| | 3 | 24 | | 20.88% (avg.) |
| | 4 | 25 | | |

By reviewing this data, it is evident that the use of Polymer A provided greater transmittance and was substantially more effective. In addition, Polymer A showed less average drainage time, and a higher % consistency means a drier sheet and a faster drainage time.

We claim:

1. A method for improving the retention of mineral fillers and cellulose fibers on a cellulosic fiber sheet, the method comprising the steps of:

a. preparing a cellulose pulp slurry;

b. adding an effective flocculating amount of a copolymer flocculant to the cellulose pulp slurry, said copolymer flocculant having a molecular weight of at least one million, the copolymer flocculant being a cationic copolymer of acrylamide and diallyl dimethyl ammonium chloride, said flocculant copolymer containing from about 20 to about 60 mole percent dially dimethyl ammonium chloride mer units;

c. shearing said cellulose pulp slurry including said copolymer flocculant;

d. adding an effective flocculating amount of a water-soluble anionic flocculant having a molecular weight of at least five million to the sheared cellulose pulp slurry; and e. forming a cellulosic fiber sheet from the cellulose pulp slurry including both the copolymer flocculant and anionic flocculant.

2. The method of claim 1 wherein the copolymer flocculant has reduced specific viscosity of from about 3 to about 30.

3. The method of claim 1 wherein the copolymer flocculant contains from about 30 to about 50 mole percent of diallyl dimethyl ammonium chloride mer units, and has a reduced specific viscosity of from about 4 to about 22.

* * * * *